US005651162A

United States Patent [19]

Keszthelyi

[11] Patent Number: 5,651,162

[45] Date of Patent: Jul. 29, 1997

[54] HYDRAULIC DOOR CONTROL SYSTEM

[76] Inventor: Laszlo Keszthelyi, 8-03 117 St., College Point, N.Y. 11356

[21] Appl. No.: 582,924

[22] Filed: Jan. 4, 1996

[51] Int. Cl.[6] ..... E05F 3/04

[52] U.S. Cl. ..... 16/51; 16/58; 16/55; 16/DIG. 9

[58] Field of Search ..... 16/51, 58, 57, 16/55, 61, 62, 64, 49, 78, 79, DIG. 9, DIG. 10, DIG. 7

[56] References Cited

U.S. PATENT DOCUMENTS

| | | | |
|---|---|---|---|
| 3,875,612 | 4/1975 | Poitras . | |
| 4,263,694 | 4/1981 | Jentsch | 16/62 |
| 4,378,612 | 4/1983 | Beers | 16/49 |
| 4,580,365 | 4/1986 | Sieg | 16/58 |
| 4,660,250 | 4/1987 | Tillman et al. | 16/58 |
| 4,995,194 | 2/1991 | Schultze et al. | 16/58 |
| 5,343,593 | 9/1994 | Fayngersh | 16/51 |

*Primary Examiner*—Chuck Y. Mah
*Attorney, Agent, or Firm*—Howard C. Miskin

[57] ABSTRACT

A hydraulic control system for automatically closing and opening a door is disclosed and has means for providing such opening and closing even if power is lost to the hydraulic control system. Further disclosed is a fluid control device of the hydraulic system which prevents the door from being opened or closed too quickly that might otherwise harm an individual that comes into the path of the moving door.

6 Claims, 3 Drawing Sheets

HYDRAULIC DOOR CONTROL SYSTEM

BACKGROUND OF THE INVENTION

The present invention relates to an automatic door operating mechanism. More particularly, the present invention relates to an automatic door that is responsive to a control system even during a power outage situation. Specifically, the present invention relates to a hydraulic control system normally responsive to electrical control signals, but also having a safety feature for achieving a closed or open condition of an automatically operated door even during a power outage situation.

An automatic door mechanism is commonly integrated with other elements all to form a system to accomplish a prescribed end purpose; e.g., an elevator control system responsive to the needs of conveying passengers, or a door control system that is responsive to the needs of the handicapped allowing ingress or egress to and from a room or building.

An elevator control system provides for the automatic stopping of an elevator at a level which is even with the floor opening of door. The elevator control system provides various safety functions; for example, causing the automatic reopening of a closing door when a passenger steps into the elevator car so as to avoid undesired contact therebetween. These safety functions are well known and performed by conventional electrical control systems.

A door control system that accommodates the needs of the handicapped shares some of the concerns of the elevator control system; for example, the opening or re-opening of a door in response to a depression of a push button or to a signal generated by motion or object detecting devices, or the like. Although the control systems that provide for automatic functions, as well as the safety functions, serve well their desired needs, these control systems suffer from the drawbacks sometimes occurring upon the loss of power which de-energizes the associated control system rendering it inoperative. It is desired that an automatic control system for operating a door be provided having safety means that function so that the opening or closing of a door may be accomplished, even in the presence of a power outage situation.

SUMMARY OF THE INVENTION

It is a principal object of the present invention to provide an automatic door control mechanism applicable to both an elevator control system and a system that accommodates the needs of the handicapped, both of such systems allowing the door to be opened or closed even during a power outage situation.

It is another object of the present invention to provide a door control mechanism that may be opened or closed in spite of a power outage condition, yet provide safety features so that the door may not be opened or closed at a rate of speed that might otherwise harm an individual if struck by the rapidly moving door.

Still further, it is an object of the present invention to provide a door control mechanism that operates without the need of electrical power and yet pre-arranges itself to be at the proper condition to accept the application of electrical power and be ready to perform its necessary functions.

These and other objects of the present invention will become apparent from a reading of the following description taken in conjunction with the accompanying drawings which illustrate a preferred embodiment thereof.

The present invention is directed to a control system having a hydraulic device for automatically closing or opening a door and having means for closing or opening the door even if electrical power is lost to the control system.

The control system is normally responsive to an electrical signal for hydraulically controlling a mechanism for moving a door to and from its opened and closed position, but allowing for the door to be moved to one of the opened or closed position in the absence of the electrical signal.

The system comprises a motor, a gear drive, a hydraulic device, means for coupling, and a switch that is actuated when the door being controlled has reached the predetermined limits of its movements. The motor is responsive to an electrical signal and has an output shaft which drives a first gear. The gear drive has a predetermined axis, as well as a first end with means for intermeshing with the first gear and a second end axially movable back and forth by a first predetermined distance. The hydraulic device comprises a housing having an axis coaxial with the axis of the gear drive, a fluid reservoir having an output port, and a device having means for controlling the flow of fluid. The housing has first and second ends and a vessel containing a piston with a head having a first end of a shaft attached thereto. The head is fitted into the vessel and is slidable back and forth therein to define a stroke thereof which, in turn, defines a first chamber. The housing has means on its first end so that the second end of the shaft is movably extendable therefrom. The second end of the housing has means for being connected to the second end of the gear drive. The device having means for controlling the flow of fluid also establishes fluid communication between the output port of the fluid reservoir and the first chamber of the housing. The means for coupling is attached to the second end of the shaft and couples the shaft to a mechanism for moving a door to and from its opened and closed positions. The switch has separate ON and OFF positions as well as measuring means to cause a transition between the ON and OFF positions when the housing is measured to have moved by a distance corresponding to the first predetermined distance. The switch is connected to electrical excitation and generates the electrical signal of the system when the switch is transitioned to its ON position.

DESCRIPTION OF THE PREFERRED EMBODIMENTS

Figure 1:
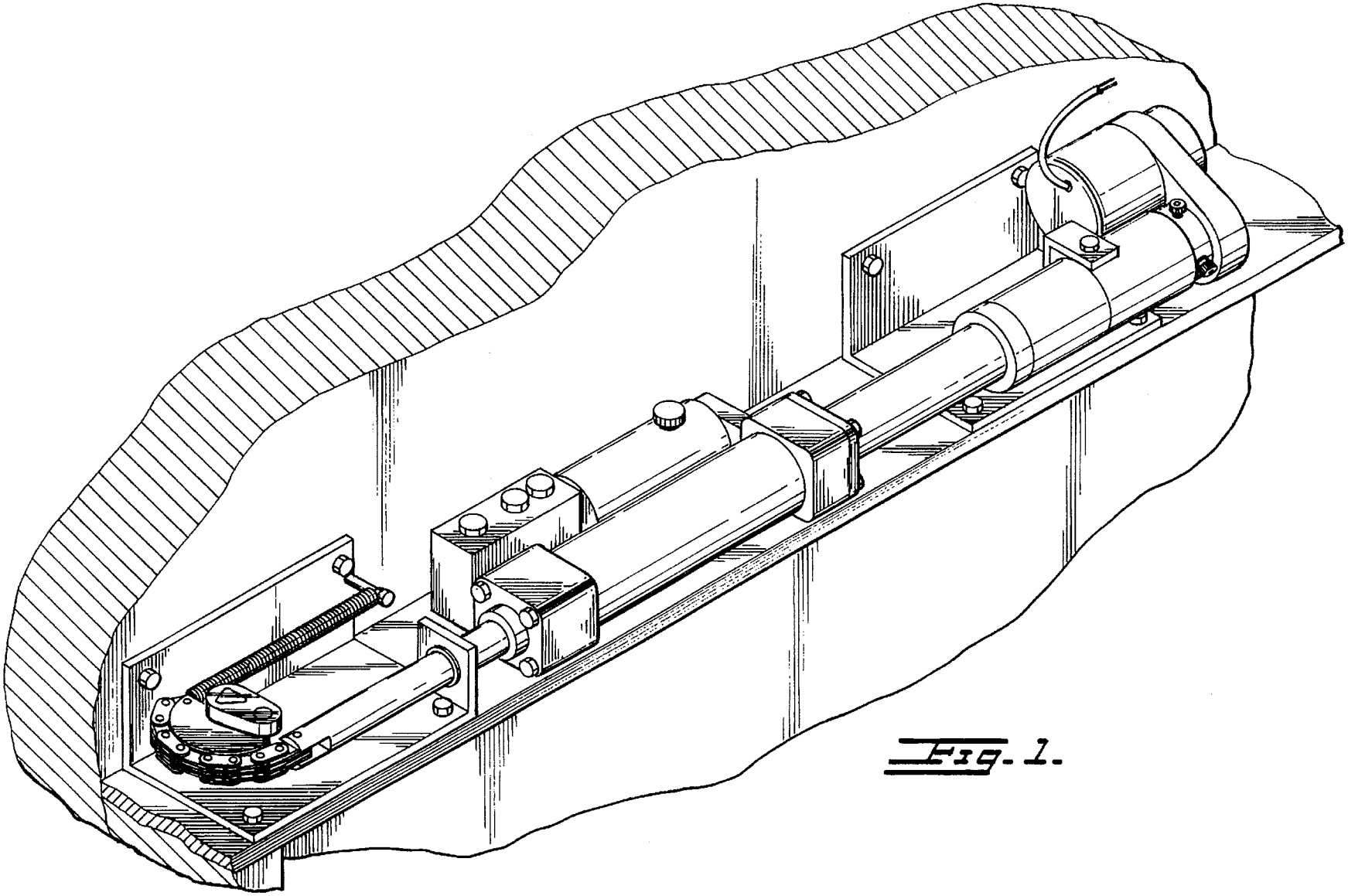
FIG. 1 is a perspective view of the hydraulic control system of the present invention located above a door being controlled by the present invention.

Referring to the drawings wherein the same reference numbers are used to indicate the same elements throughout, there is shown in FIG. 1 a perspective view of a hydraulic control system of the present invention. The hydraulic control system operates with or without the assistance of electrical power and, thus, is particularly suited to serve as an integrated element of elevator control systems for operating a door or for a control system for operating a door for handicapped individuals both of which control systems may encounter power outages, and both of which control systems desire the safety feature of manually opening or closing a door during such power outages.

The hydraulic control system 10 comprises a motor 12 responsive to an electrical signal carried by cable 14 and generated by a control network 16, a gear drive 18, a hydraulic device 20, a coupling device 22, and a switch 24 (not shown in FIG. 1 but shown in FIG. 2) which produces an electrical signal carried by cable 26 to the control network 16.

Control network 16 may be comprised of electronic devices known in the art for controlling an elevator, or if the hydraulic control system 10 is used to control a door serving the needs of the handicapped, the control network 16 may be of the type described in U.S. application Ser. No. 08/376,297 herein incorporated by reference. For the practice of the present invention, a control network 16 need only supply a control signal routed in cable 14 that is applied to the motor 12 and be responsive to an electrical signal routed in cable 26 and generated by the switch 24.

The motor 12 has an output stage 28 arranged to rotatably drive a gear 30 (not shown in FIG. 1 but shown in FIG. 2) that is attached to the gear drive 18 by means of one or more Phillips head screws 32. The motor 12 and the gear drive 18 rest upon a first base plate 34 which is attached to both a wall 36 and a shelf 38 by means of screws 40. The shelf 38 is located above a door 42 being controlled by a system 10.

The gear drive 18 is connected to the base plate 34 by means of a bracket 44 and a clamping screw 46. The gear drive 18 has a first end 48 with means (to be described with reference to FIG. 2) intermeshing with the gear 30 of the output stage 28 of the motor drive 12. The gear drive 18 has a second end 50 with an end wall 52 that is movable back and forth, in an axial manner, by a first predetermined distance (to be described with reference to FIG. 2) and is attached to one end of a housing 54 by means of an end cap 56 and screws 58. The housing 54 is actually part of the hydraulic device 20.

The hydraulic device 20 further comprises a fluid reservoir 60 having a vented cap 60A, and a control device 62 having first, second and third adjustable valves 64, 66, 68 respectively. The control device 62 abuts up against a second end cap 70 connected to the housing 54 by means of screws 72. The end cap 70 has a collar 74 that guides a shaft 76 (attached to a piston not shown), exiting from the housing 54. The shaft 76 passes through a collar 78 of an extension 80 of a second base plate 82 connected to both the wall 36 and shelf 38 by means of screws 84. The base plate 82 has an opening (not shown) that allows for the coupler 22 to be connected to the door 42.

The coupler 22 has sprockets (not shown) into which mesh, in a complementary manner, links of a chain 86 having one end that is connected to the shaft 76 by means of a pin 88 placed into both separated legs 90 and 92 of the shaft 76. The other end of the chain 86 is connected to one end of a spring 94 having its other end connected to an extension pin 96 fastened to the second base plate 82. The coupler 22 has an output shaft (not shown) passing through the second base plate 82 that is connected to a door opening mechanism that is part of the elevator control system, or that is part of the automatic door opening system for a handicapped, into either of which system the hydraulic control system 10 finds particular application. The coupler 22 is not considered part of the present invention, but further details of its operation may be further described with reference to the previously incorporated by reference U.S. patent application Ser. No. 08/376,297.

Figure 2:
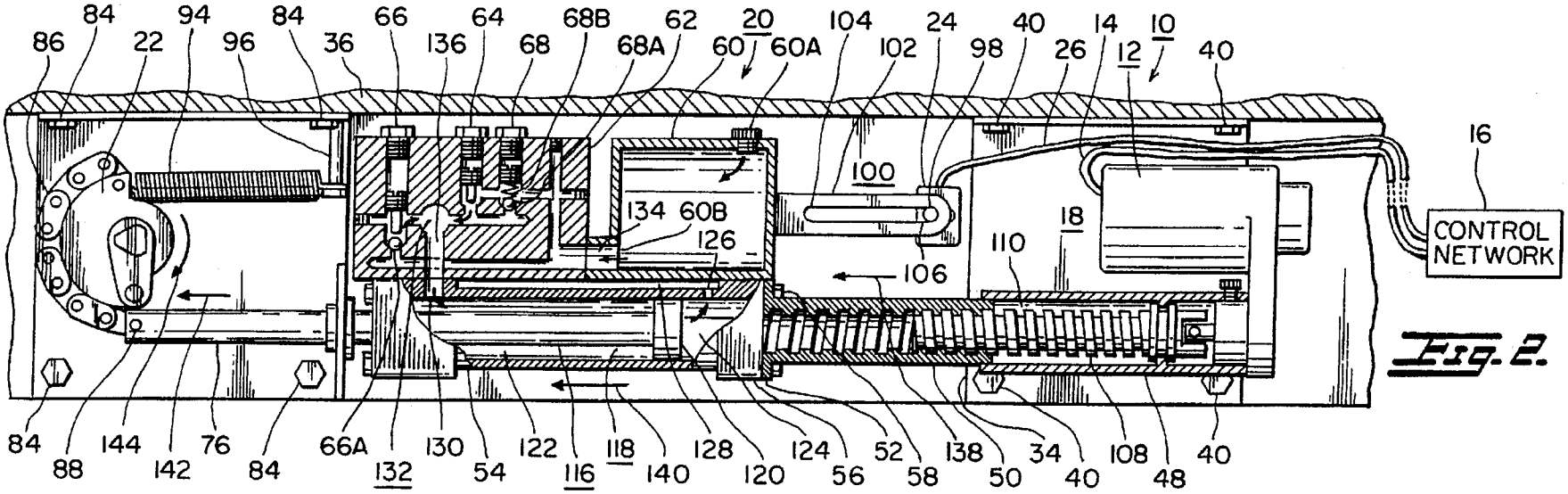
FIG. 2 is a schematic of the hydraulic control system in its at-rest, standby condition.

The switch 24 operation is considered part of the present invention and may be further described with reference to FIG. 2 which illustrates the switch 24, as well as the hydraulic control system 10 in their at-rest or standby condition, that is, with the door 42 preferably in its closed position, or conversely, if desired, with the door 42 in its opened condition. For the embodiment of FIG. 2, as well as FIGS. 3 and 4, the switch 24 is shown as being located externally from the motor 12. However, the switch 24, which serves essentially as a limit switch, may be placed in the motor 12 in a manner known in the art. The switch 24 of FIG. 2, has an extension 98 that is positionable and slidable in an opening 100 of a bracket member 102, which for the embodiment of FIG. 2 is connected to the reservoir 60. The opening 100 has first and second ends 104 and 106, respectively, spaced apart from each other by a first predetermined distance corresponding to the distance defining the stroke of a hydraulic cylinder to be described within the housing 54.

The switch 24 has separate ON and OFF positions which are transitioned therebetween in response to the movement of bracket 102 serving as a measuring device 102. More particularly, the switch 24 is transitioned into its ON position when its extension 98 comes into contact with the end 106 of measuring device 102 and, conversely, is transitioned into its OFF position when its extension 98 comes into contact with the end 104 of the measuring device 102. The measuring device 102, in the embodiment shown in FIG. 2, moves indirectly in response to the drive motor 12.

Drive motor 12 at its output stage 28 has a gear 30 that is coupled to and intermeshing with a worm gear 108. The motor 12, in particular the output stage 28 thereof, is arranged to rotatably drive the gear drive 18, in particular the worm gear 108 thereof, which, in turn, axially moves in and out corresponding the direction of rotation of the motor 12.

The worm gear 108 is axially located within a coaxial bore of a long tubular member serving as the first end 48, already discussed with reference to FIG. 1 and fits within complementary matching teeth 112 located within a movable and extractable member serving as the second end 50, already discussed with reference to FIG. 1. The movable and extractable member 50 carries end wall 52, also previously described, that is connected to the housing 54 by means of the screws 58.

The housing 54 is preferably cylindrical in shape and has a first vessel 116 that is coaxial with the worm gear 108 and which is actually a coaxial bore of housing 54 and into which is inserted and fitted a piston 118, comprising a head 120 and the shaft 76 previously described. The head 120, as well as the shaft 76, is slidable back and forth within the vessel 116 and defines a stroke thereof which also defines a first chamber 122. More particularly, the total distance of the axial movement of the head 120 covering its back and forth directions defines the stroke of the piston 118. The total volume of the vessel 116 occupied by the piston 118, including all of its axial movement, defines the first chamber 122 in which the fluid of reservoir 60 is confined. The remainder of the vessel 116 not occupied by the first chamber 122 forms a second chamber 124 preferably having an opening 126 that leads into a third chamber 128 which, for the embodiment shown in FIG. 2 is enclosed, filled with air, and located below the control device 62.

The control device 62 establishes fluid communication between an output port 60B of the fluid reservoir 60 and the first chamber 122, by way of input port 130 thereof. As seen in FIG. 2, the fluid control device 62 has a first passageway 132 having branches and a lower first main trunk (as viewed in FIG. 2) that is in registry with and leads into the input port 130 of the first chamber 122. Further, the first passageway 132 also has upper branches that lead into the output port 60B of the reservoir 60. The control device 62 has a second passageway 134 having branches and a main trunk. The main trunk of the second passageway 134 leads directly into the output port 60B, whereas one of the branches, having a portion 136 partially shown in phantom, is adjustably blocked by a ball 66A of the second adjustable valve 66 that seats itself, as shown in FIG. 2, on an orifice in the second passageway 134.

The first adjustable valve 64, in cooperation with the second and third adjustable valves 66 and 68, respectively, control the amount of fluid flow and the direction of the fluid communication between the output port 60B of the reservoir 60 and the input port 130 of the first chamber 122. The fluid may be any suitable working fluid, such as oil, typically found in fluid control devices, such as control device 62.

The first adjustable valve 64, sometimes referred to as a needle valve, controls the amount of fluid flowing through an orifice located proximate thereto, as seen in FIG. 2, and has a non-impeded path, that is, not selectively terminated in the fluid communication path between the output port 60B and the input port 130 of the first chamber 122. The amount of fluid is adjustable and is determined by the amount of the extension of the stem of the first adjustable valve 64 into the associated orifice.

The second adjustable valve 66, in particular its ball 66A, determinates the direction of the fluid flowing through the orifice located proximate thereto as shown in FIG. 2. More particularly, when ball 66A sits in the associated orifice, as shown in FIG. 2, the flow of fluid, in the associated branch, from output port 60B to the input port 130 is terminated. However, the termination is overridden if the fluid is flowing in a direction from the input port 130 to the output port 60B. More particularly, a flow in this latter direction lifts or unseats the ball 66A from its valve seat.

The third adjustable valve 68 comprises a ball 68A and a spring 68B. The third adjustable valve 68 adjusts the spring constant of the spring 68B which, in turn, adjusts the pressure to which the ball 68A is insertable into and sits on the orifice located approximate thereto, as shown in FIG. 2. The third adjustable valve 68 allows for the selective termination of fluid flowing through the associated orifice, but which termination is overridden if the rate of the fluid flow from the input port 130 to the output port 60B exceeds a predetermined value, in a manner to be described herein with reference to FIG. 4.

OPERATION OF THE HYDRAULIC CONTROL SYSTEM 10

Figure 3:
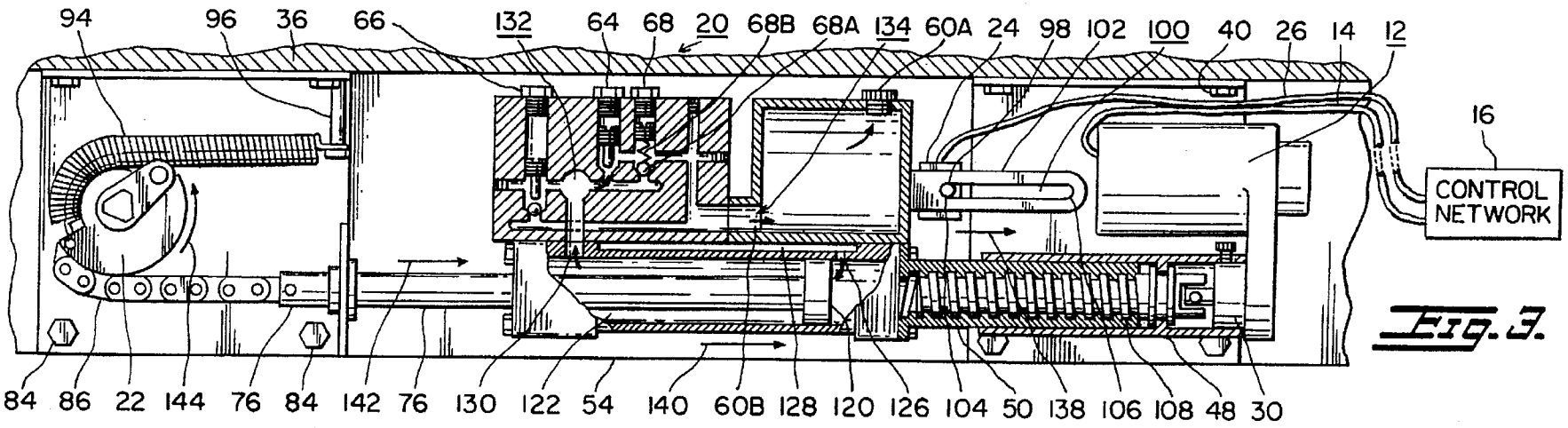
FIG. 3 is a schematic of the hydraulic control system in its door open condition.
Figure 4:
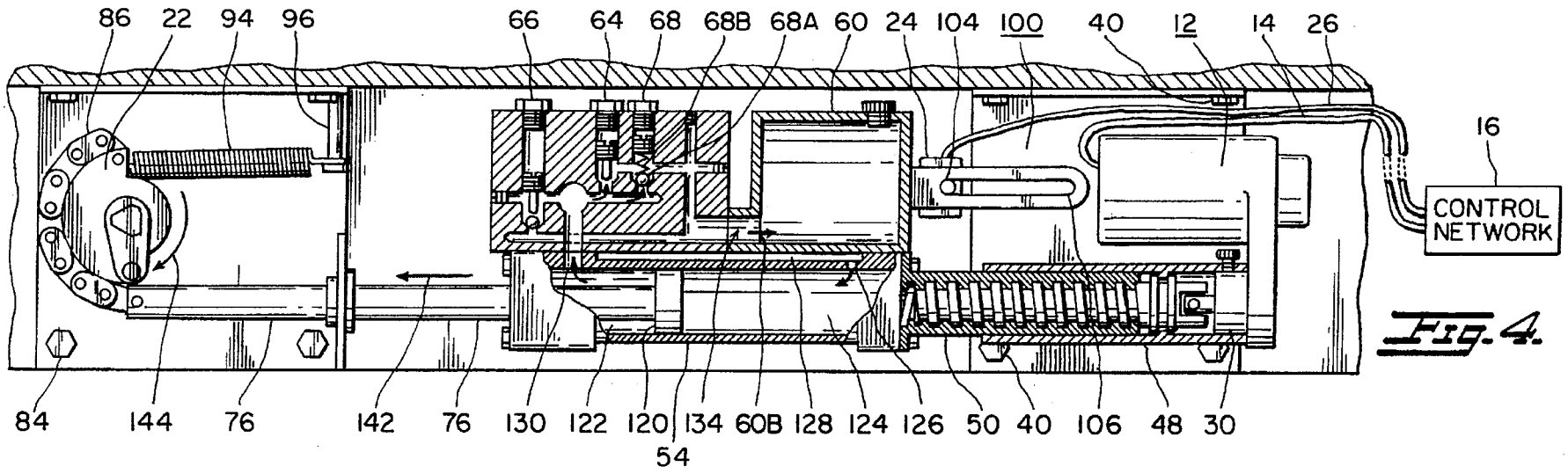
FIG. 4 is a schematic of the hydraulic control system illustrating the operation that is achieved during a power outage condition which allows for a door that has been undesirably left open to be returned to its closed condition.

The operation of the hydraulic control system 10 may be described with reference to FIGS. 2, 3 and 4, wherein FIG. 2 illustrates the stand-by or at-rest condition of the hydraulic control system 10. FIG. 3 illustrates the condition of the hydraulic control system 10 after it has been activated by the control network 16 and responds by opening the associated door. FIG. 4 illustrates the operation of the hydraulic control system 10 during a power outage situation in which the open door of FIG. 3 is allowed to be closed manually for attendant safety purposes.

With reference to FIG. 2, the hydraulic control system 10, upon the application of power, causes the motor 12 to drive the worm gear 108 so that the extractable extension 50 is moved outward in the direction indicated by arrow 138 which, in turn, causes the hydraulic device 20 to be moved in a direction indicated by arrow 140, with both directions 138 and 140 being in a coaxial manner with respect to the axes of both the gear drive 18 and the housing 54. The movement of the hydraulic device 20 in direction 140 causes the output shaft 76 to be moved in the direction indicated by arrow 142 which, in turn, causes the chain 86 to move the sprocket of coupler 22 clockwise in a direction 144 which, in turn, causes the door closing mechanism to close the associated door. The manner in which the door closing mechanism operates is not considered part of the present invention, but details thereof may be found in the previously incorporated by reference U.S. patent application Ser. No. 08/376,297.

When the door has been moved from its open to its closed position, the output shaft 76 and the housing 54 have both traveled the first predetermined distance so that the measuring device 102 has correspondingly moved its opening 102 (originally at end 104) in a manner that its end 106 now comes into contact with extension 98 of switch 24 which causes the switch 24 to transition to its OFF condition which, in turn, removes the electrical signal being transferred to control network 16, via cable 26, which, in turn, responds by removing the electrical signal being applied to the drive motor 12 via cable 14.

The conditions of the door (not shown) and the hydraulic control system 10 shown in FIG. 2 are that which are obtained during both a door closing operation, which seeks an at-rest condition, and a power-on operation which seeks a standby condition. The door may be transitioned from its closed position to its opened position in a manner that may be described with reference to FIG. 3, which incorporates all of the elements of FIG. 2, but only depicts the reference numbers needed to illustrate the closing operation of the door.

To transition from the closed (FIG. 2) to the opened (FIG. 3) condition of the associated door, the control network 16 generates an electrical signal that is applied to drive motor 12 via cable 14 which, in turn, causes the first gear 30 of motor 12 to drive the worm gear 108 so that the retractable and extendable member 50 is moved in a direction 138 (inward as viewed in FIG. 3) which, in turn, moves or drags the hydraulic device 20 in a direction indicated by arrow 140. The movement of the hydraulic device 20 causes its output shaft 76, as well as the housing 54, to be moved in the direction indicated by arrow 142 which, in turn, causes its chain 86 to move the coupler 22 in a counterclockwise direction indicated by arrow 144 which, in turn, causes the associated door closing mechanism to open the door. The movement of the hydraulic device 20 causes the end 104 to come into contact with extension 98 of switch 24 to cause the removal of excitation to the motor 12 by way of the control network 16.

During such door opening, it may be seen in FIG. 3 by a review of the small arrows indicated therein, that air is drawn out of the third chamber 128 and enters the second chamber 124 by way of the opening 126. Further, the working fluid confined in the first chamber 122 flows out of input port 130 and flows up into passageway 132 and past the first adjustable valve 64, but is blocked by the third adjustable valve 68. The flow of fluid past the first adjustable valve 64 enters the output port 60B of reservoir 60 and seeks to exit the vented cap 60A as seen in FIG. 3. If during this open door condition illustrated in FIG. 3, a power outage occurs, leaving the door in an unsafe-open condition, an individual, whether handicapped or not, may easily and manually close the door and which closing may be further described with reference to FIG. 4 that for the sake of clarity, and in a manner similar to FIG. 3, only depicts reference numbers that are needed to illustrate the manual closing operation.

A comparison between FIGS. 4 and 3 reveals the same position for retractable member 50, which, without the benefits of the present invention, would leave the door in its open condition. However, it should be noted that the position of the head 120 in the housing 54 illustrated in FIG. 4 is different than the position of the head 120 in the housing 54 of FIG. 3. This difference in position is obtained by a person grasping the open door (not shown) and applying pressure so that the door closing mechanism moves in a direction to cause the coupler 22 to be rotated in the clockwise direction, illustrated by arrow 144 of FIG. 4, which, in turn, causes the chain 86 to be also moved in this same direction 144 which, in turn, causes the shaft 76 to be moved outward (as viewed in FIG. 4) in a direction indicated by arrow 142. A comparison now between FIG. 4 and FIG. 2 (closed condition of associated door) reveals that the position of the coupler 22 in both figures is the same, representing that the door is in its closed or stand-by condition.

From FIG. 4, in particular from the smaller arrows illustrated therein, it should be observed that the air is drawn out of the third chamber 128 and into the second chamber 124 via opening 126 in a similar manner as described for FIG. 3. Further, the fluid within the first chamber 122 is drawn out of the first chamber 122 by way of the input port 130 in a similar manner as described for FIG. 3. The removed fluid flows past the first adjustable valve 64, but does not flow past the third adjustable valve 68. However, if the manual movement of the door from its open position to its desired closed position causes the fluid to flow at a rate indicating that the door is being moved too fast, the ball 68A of the third adjustable valve 68 is moved upward and out of its seat, thereby, allowing more fluid originating from the first chamber 122 to be directed back toward the output port 60B of the reservoir 60.

It should now be appreciated that the practice of the present invention provides for a hydraulic control system 10 that not only causes the opening and the closing of an associated door in response to an electrical control system, but also allows the door to be opened or closed in the presence of a power outage situation.

Further still, it should be appreciated that the practice of the present invention provides for the safety conditions even in the presence of a power outage situation. More particularly, the hydraulic control system 10 provides for a control system that prevents the door from being closed too quickly in the presence or absence of a power outage situation.

Still further, it should be appreciated that the present invention allows for the hydraulic control system to be placed into a stand-by condition upon the application of electrical power allowing for its immediate response to any control signals from an electronic control system of an elevator or from a door controlling mechanism for that of the handicapped.

Although a preferred embodiment of the present invention has been described and illustrated, it is apparent that numerous alterations, omissions and additions may be made without departing from the spirit thereof.

What I claim is:

1. A system responsive to an electrical signal for hydraulically controlling a mechanism for moving a door to and from its opened and closed position, but allowing for the door to be moved to one of the opened and closed positions in the absence of said electrical signal, said system comprising:

(a) a motor responsive to an electrical signal and having an output shaft which drives a first gear;

(b) a gear drive with a predetermined axis having a first end with means for intermeshing with said first gear and a second end axially movable back and forth by a first predetermined distance;

(c) a hydraulic device comprising:

(i) a housing with an axis coaxial with the axis of said gear drive having first and second ends and a vessel containing a piston with a head having a first end of a shaft attached thereto, said head fitted in said vessel and slidable back and forth therein to define a stroke thereof, said head movement defining said stroke encompassing a volume within said vessel which in turn defines a first chamber, said housing having means on its first end so that the second end of said shaft is movably extendable therefrom, said second end of said housing having means for being connected to said second end of said gear drive;

(ii) a fluid reservoir having an output port;

(iii) a device having means for controlling the flow of fluid and establishing fluid communication between said output port of said fluid reservoir and said first chamber of said housing;

(d) means for coupling said second end of said shaft to a mechanism for moving a door to and from its opened and closed positions; and (e) a switch having separate ON and OFF positions and having measuring means to cause a transition between the ON and OFF positions when said housing is measured to have moved by a distance corresponding to said first predetermined distance, said switch being connected to electrical excitation and generating said electrical signal of said system when said switch is transitioned to said ON position.

2. The system according to claim 1, wherein said housing has a second chamber comprising the remainder of said vessel not occupied by said first chamber, said second chamber having a passageway leading into a third chamber, said third chamber being free of said piston and serving as an extension of said second chamber.

3. The system according to claim 2, wherein said third chamber is enclosed and filled with air.

4. The system according to claim 1, wherein said output shaft of said motor is arranged to rotatably drive said first gear and said gear drive comprises a worm gear that intermeshes with said first gear.

5. The system according to claim 1, wherein said defined stroke covers a distance which is substantially equal to said first predetermined distance.

6. The system according to claim 1, wherein said device for controlling the flow of fluid comprises:

(a) a first adjustable valve for controlling the amount of fluid flowing through a first orifice that has a non-impeded path in the fluid communication path between said output port and said first chamber;

(b) a second adjustable valve for selectively terminating the fluid flowing through a second orifice, said second adjustable valve having means such that said terminating is overridden if the fluid is flowing from said output port to said first chamber;

(c) a third adjustable valve for selectively terminating the fluid flowing through a third orifice, said third adjustable valve having means such that said terminating is overridden if the rate of fluid flowing from said first chamber to said output port exceeds a predetermined value.

* * * * *